US007585438B2

(12) United States Patent
Sommer

(10) Patent No.: US 7,585,438 B2
(45) Date of Patent: Sep. 8, 2009

(54) METHOD FOR THE CLEANING OF FILAMENT AND FIBER SPINNING DEVICES

(75) Inventor: Sebastian Sommer, Troisdorf (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 573 days.

(21) Appl. No.: 10/799,915

(22) Filed: Mar. 11, 2004

(65) Prior Publication Data

US 2004/0216767 A1 Nov. 4, 2004

(30) Foreign Application Priority Data

Mar. 14, 2003 (EP) ..... 03005796

(51) Int. Cl.
*B08B 7/00* (2006.01)
*D01D 4/04* (2006.01)

(52) U.S. Cl. ..... 264/39; 134/2; 134/5; 134/21; 134/39; 134/42

(58) Field of Classification Search ..... 264/39; 134/2, 5, 21, 39, 42
See application file for complete search history.

(56) References Cited

U.S. PATENT DOCUMENTS 2,907,687 A * 10/1959 Scigliano ..... 134/5
T948,004 I4 * 7/1976 Casey et al. ..... 264/39
4,002,426 A * 1/1977 Chenevey et al. ..... 8/115.54
4,160,637 A * 7/1979 Jordan ..... 264/39 X
5,011,541 A * 4/1991 Leech ..... 134/34
5,728,226 A * 3/1998 Hoyt ..... 264/39 X

FOREIGN PATENT DOCUMENTS

| | | |
|---|---|---|
| DE | 4 017 296 | 12/1990 |
| JP | 44000892 | 4/1967 |
| JP | 53043751 | 4/1978 |
| JP | 3019906 | 1/1991 |

* cited by examiner

*Primary Examiner*—Leo B Tentoni
(74) *Attorney, Agent, or Firm*—Andrew Wilford

(57) ABSTRACT

Method for the cleaning of spinning devices with a plurality of spinning apertures for the output of molten plastic. With the spinning device in operation, individual dirt-contaminated and/or clogged spinning apertures are closed with plugs, these plugs-consisting of at least in part of at least one oxidizable substance. The spinning device is subjected in the course of its cleaning to a pyrolysis treatment for the breakdown of residual plastic. The spinning device is subjected to an oxidative treatment, so that the oxidizable substance is oxidized.

16 Claims, 1 Drawing Sheet

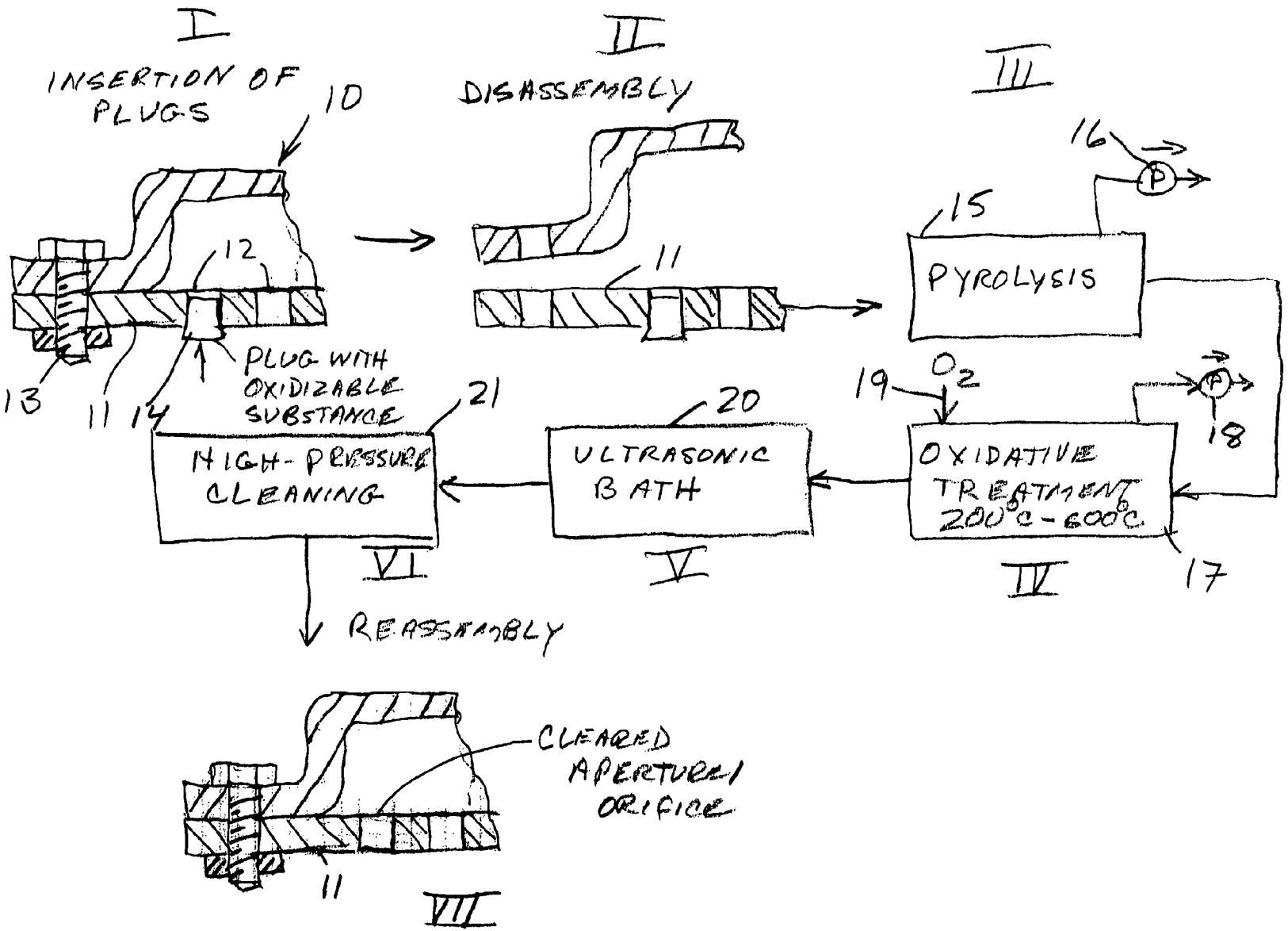
I
INSERTION OF PLUGS
10
12
PLUG WITH OXIDIZABLE SUBSTANCE
14
11
13
II
DISASSEMBLY
11
III
PYROLYSIS
15
16
P
IV
OXIDATIVE TREATMENT 200°C - 600°C
17
18
P
O2
19
V
ULTRASONIC BATH
20
VI
HIGH-PRESSURE CLEANING
21
REASSEMBLY
VII
CLEANED APERTURED ORIFICE
11

METHOD FOR THE CLEANING OF FILAMENT AND FIBER SPINNING DEVICES

FIELD OF THE INVENTION

My invention relates to a method of cleaning spinning devices with a plurality of spinning apertures for the output of molten plastic. More particularly, the invention relates to a method of operating a spinning device which includes the cleaning thereof.

BACKGROUND OF THE INVENTION

Spinning devices are used primarily for the manufacture of endless filaments, which in the first instance emerge from the spinning holes, spinning orifices or spinning nozzles, and are then in particular deposited so as to form spunbond nonwoven materials. A spinning plate may have several thousand spinning apertures. The term "spinning device" relates within the framework of the invention to the most widely differing spinning processes. In this context, "spinning devices" may even mean, for example, melt-blown filament blowing heads.

With the spinning devices known from practice, as a rule a filter is arranged upstream of the spinning plate, which catches inhomogeneities in the melts introduced. After prolonged operation of the spinning device, parts of this filter may become clogged and/or some of the spinning apertures or capillaries may be contaminated by impurities. If the impurities and/or clogging are serious, the spinning plate must be dismantled and cleaned, and, if necessary, refitted with a new filter. However, if only a few spinning apertures or spinning capillaries are contaminated or impaired in their function due to impurities in the filter, it is more economical for the spinning apertures which are no longer functioning properly to be temporarily closed off by closure elements or by plugs. Only when the dirt contamination increases, or if a considerable number of apertures can no longer be used properly, is the spinning plate dismantled for the purpose of cleaning. Cleaning is carried out as a rule by means of a pyrolysis treatment, in which, with underpressure and/or inert conditions, the plastic residue and impurities adhering to the spinning plate are gasified. Subsequent cleaning can be carried out in ultrasound baths and/or with high-pressure cleaners. By means of the latter treatment measures residual ash in particular can be removed.

With the method known from practice, the clogged spinning apertures, or those impeded in their function, are temporarily closed of with closure elements in the form of graphite plugs. These graphite plugs are produced from a graphite/clay mixture. The graphite is accordingly likewise present in these graphite plugs in a fired ceramic bond. The ceramic bond is thermally stable up to temperatures in excess of 1000° C. During later cleaning of the spinning device or the spinning plate, these graphite plugs must be removed in their entirety, in order for all the spinning apertures to be fully functional as in the original condition of the spinning plate.

The removal of the graphite plugs within the framework of the cleaning measures known from practice, with conventional spinning apertures, is easily possible in the form of round capillaries with diameters of, for example, 0.4 to 1 mm. If problems nevertheless arise, it is possible, within the framework of these known measures to carry out an additional mechanical cleaning, for example with a wire or the like. This has the disadvantage, however, that with spinning apertures with small diameters there is a risk of damage to the spinning apertures. This applies in particular, however, to spinning apertures with special outlet cross-sections, such as spinning apertures for hollow fibers and the like. These outlet apertures frequently have gap widths of less than 0.4 mm. A mechanical cleaning, such as with a wire, for example, without damage to the spinning apertures is difficult or impossible.

OBJECTS OF THE INVENTION

An object of the invention is to provide a method of the type described at the outset with which a very effective cleaning of the spinning device or spinning plate is possible, and with which, in addition, the plugs introduced in the interim can be easily removed from the spinning apertures associated with them in a functionally reliable manner.

More particularly, it is an object of the invention to provide a method of operating a spinning device or spinning plate assembly which includes the cleaning thereof.

Still another object of the invention is to provide an improved method of operating a spinning device for spunbond and meltblown filaments and fibers in which the cleaning operation is improved.

SUMMARY OF THE INVENTION

To achieve these objects, the invention provides a method for the cleaning of spinning devices with a plurality of spinning apertures for the emission of molten plastic, whereby, with the spinning device in operation, individual dirt-contaminated and/or clogged spinning apertures are closed with plugs, these plugs consisting at least in part of at least one oxidizable substance, the spinning device is subjected, in the course of its cleaning, to a pyrolysis treatment under high temperatures in order to bring about the decomposition of the residual plastic, and the spinning device is subjected to an oxidative treatment, so that the oxidizable substance is oxidized. Due to the aforesaid oxidation of the oxidizable substance, which is a constituent part of the plugs, a very straightforward, functionally reliable, and complete removal of the plugs from the spinning apertures is possible.

A spinning device according to the invention comprises in particular a spinning plate that is provided with a plurality of spinning apertures. As already indicated in the preamble, the term "spinning device" even means, for example, melt-blown filament-blowing heads or the spinning plates of short-fiber spinning systems or other spinning systems.

The fact that, with the spinning device in operation, spinning apertures are closed with plugs, means that the plugs are introduced into the spinning apertures in the period of time before a cleaning or basic cleaning, i.e. before the temporary removal of the spinning plate. Only when a considerable number of spinning apertures are no longer functioning properly or are contaminated with dirt and/or clogged does the cleaning of the spinning device take place according to the invention with the pyrolysis treatment and the oxidative treatment.

Within the framework of the invention "plugs" means a closure element which is adjusted in its cross-sectional shape or cross-sectional dimensions to the spinning apertures or spinning holes. It falls within the framework of the invention that a plug is pushed into a spinning hole which is to be closed, and to this purpose is wedged in the spinning hole.

It falls within the framework of the invention that the plugs consist of at least one first substance and of at least one second substance in the form of an oxidizable binding agent. The oxidizable binding agent accordingly likewise forms an oxidizable binding agent for the first substance.

According to a highly preferred embodiment, which acquires very particular significance within the framework of the invention, the plugs consist of graphite and an oxidizable substance. It is not ignored, in this situation, that graphite is basically likewise oxidizable.

According to a preferred embodiment of the invention, however, the plug consists in part of an oxidizable substance other than graphite. Within the framework of the invention, the terms "oxidizable substance" or "oxidizable binding agent" do not include graphite. Preferably, the other oxidizable substance is a substance which is oxidizable more easily or under milder conditions than graphite. According to a very highly preferred embodiment, which acquires very particular significance within the framework of the invention, the oxidizable substance consists at least in part of purely amorphous carbon. Amorphous carbon in this situation means, in particular, at least one substance from the group of soot, wood charcoal, activated-carbon, coke, gas coals, animal charcoal. As is known, graphite differs from amorphous carbon in that a regular layer lattice or graphite lattice is present, while amorphous carbon does not exhibit such a regular structure.

It falls within the scope of the invention that, with an increase in the dirt contamination and/or clogging of the spinning plate or its spinning apertures, the spinning plate is dismantled for cleaning. The pyrolysis treatment and the oxidative treatment are then carried out. According to a highly preferred embodiment of the invention, the pyrolysis is carried out at under-pressure and/or under inert conditions. The pyrolysis serves to gasify the plastic residue or dirt contamination adhering to the spinning device or spinning plate respectively. "Under-pressure" means in particular that the pyrolysis is carried out in a vacuum or partially under vacuum conditions. For the pyrolysis, hot steam may be used for example, while it also lies within the framework of the invention for the pyrolysis to be carried out under an inert protective gas.

Preferably, the pyrolysis treatment is followed by a cleaning of the spinning device or spinning plate respectively in an ultrasound bath. To this purpose, in addition, the pyrolysis treatment is followed by a cleaning of the spinning device or spinning plate, carried out with a high-pressure cleaner. The two cleaning methods referred to serve in particular to remove residual ash left after the pyrolysis. Preferably, the pyrolysis treatment is followed in the first instance by a cleaning in the ultrasound bath, and then by a cleaning with a high-pressure cleaner.

It lies within the framework of the invention that, after the pyrolysis treatment and, as appropriate, after the cleaning in the ultrasound bath and/or the cleaning with a high-pressure cleaner, the oxidative treatment of the spinning device takes place.

According to a highly preferred embodiment of the invention, the oxidative treatment of the spinning device or spinning plate respectively is carried out at temperatures of above 100° C., preferably above 150° C., and for most preferably above 200° C., in the presence of at least one oxidizing medium. It lies within the scope of the invention that the oxidative treatment is carried out at temperatures from 200 to 600° C., preferably from 250 to 550° C., and most preferably from 350 to 500° C. To the purpose, air and/or pure oxygen is used as the oxidizing medium. In principle, however, the use of other oxidizing media or other oxidation means is also possible. During the oxidative treatment, oxidation takes place of the amorphous carbon contained in the plugs to form carbon dioxide. This allows for a particularly effective removal of the plugs from the spinning apertures allocated to them. According to a particularly preferred embodiment of the invention, the oxidative treatment is carried out at reduced pressure. "Reduced pressure" in this situation means a pressure which lies below atmospheric pressure.

Preferably, the oxidative treatment is followed by a cleaning of the spinning device or spinning plate in the ultrasound bath. To the purpose, in addition, after the oxidative treatment a cleaning is carried out of the spinning device or spinning plate with a high-pressure cleaner. Preferably, cleaning is carried out first in the ultrasound bath and thereafter with the high-pressure cleaner. It lies within the framework of the invention that the method step sequence of "oxidative treatment—ultrasound bath cleaning—high-pressure cleaning" is repeated at least once.

Inasmuch as a cleaning of the spinning device or spinning plate takes place after the pyrolysis treatment and/or after the oxidative treatment, using a high-pressure cleaner, a high-pressure cleaner with round hole nozzles has proved particularly effective. In addition, a preferred embodiment of the invention is characterized in that a high-pressure cleaner is used which operates with a pulsed fluid jet or with pulsed fluid jets.

The invention is based on the recognition that, with the method according to the invention, a complete and functionally reliable cleaning of a spinning device or a spinning plate respectively is possible. It is to be emphasized that this cleaning can be carried out with relatively low expenditure. The plugs introduced beforehand into specific spinning apertures can be removed easily and completely in the course of the cleaning. Because of the effective cleaning with the method according to the invention, additional cleaning steps, in particular mechanical steps, are no longer required. As a result, the damage associated with mechanical cleaning measures is of course also avoided.

BRIEF DESCRIPTION OF THE DRAWING

The sole FIGURE of the drawing is a flow diagram illustrating the method of the invention.

SPECIFIC DESCRIPTION

In the drawing I have shown a method of operating a spinning device 10 which comprises a spinning plate 11 having spinning apertures or orifices 12, also referred to as nozzles or orifices and in which the spinning plate is held onto the spinning head, for example by bolts 13.

In the course of spinning operations, certain spinning apertures or orifices can be closed according to the invention by plugs 14 which can contain an oxidizable binder, especially amorphous carbon 4 or another substance which is usually less oxidizable and may be, for example graphite. The first stage of the method of the invention, represented at I, therefore, involves the insertion of those plugs in individual dirt-contaminated and/or clogged spinning apertures. When the number of plugs which have been so inserted becomes sufficient to initiate a cleaning operation, the spinning device is disassembled, e.g. in step II as illustrated in the drawing and the spinning plate 11 is then forwarded to a pyrolysis furnace 15 which is operated at a subatmospheric pressure generated by a suction pump 16 and in which the plate 11 is subjected to an elevated temperature reducing any plastic residues on that plate to ash. This is represented by stage III of the illustrated process.

The next stage IV involves an oxidative treatment in a furnace 17 which also may be at a subatmospheric pressure as produced by a suction pump 18 and is capable of subjecting the aperture plates 11 to oxidation at a temperature between 200° C. and 600° C. The oxidizing agent, e.g. oxygen, maybe supplied at 19.

Following that oxidative treatment which destroys the plug binder, leaving a powder residue, e.g. of graphite, the plates are introduced into an ultrasonic bath 20 (stage V). That bath 20 may consist of water which is excited with ultrasonic transducers. Following the ultrasonic bath, the plates are subjected to jets of high-pressure fluid (liquid or air) in the high-pressure cleaning stage 21 represented at VI, whereupon the plate 11 may be reassembled to the spinning head as shown in stage VII.

I claim:

1. A method of operating a spinneret having a multiplicity of spinning apertures through which a molten plastic is forced to form filaments, the method comprising the steps of:

a) closing dirt-contaminated or clogged spinning apertures of the spinneret with plugs consisting at least in part of at least one oxidizable binder substance consisting at least partially of amorphous carbon which, upon oxidative decomposition, is destroyed;

b) subjecting at least a portion of the device containing the apertures and the plugs to a pyrolysis treatment for breakdown of residual plastic on the portion of the device;

c) thereafter subjecting the portion of the device to an oxidative treatment to oxidize and destroy the binder substance of the plugs and reduce the plugs to ash; and d) cleaning the ash from the portion.

2. The method defined in claim 1 wherein the plugs consist of graphite and the oxidizable substance.

3. The method defined in claim 1 wherein the pyrolysis treatment of step b) is carried out at a subatmospheric pressure.

4. The method defined in claim 3 wherein the pyrolysis treatment of step b) is carried out under inert conditions.

5. The method defined in claim 1 wherein the oxidative treatment of step c) is carried out at a temperature above 100° C. in the presence of at least one oxidizing medium.

6. The method defined in claim 1 wherein the oxidative treatment is carried out at a temperature above 150° C.

7. The method defined in claim 6 wherein the oxidative treatment is carried out at a temperature between 200° C. and 600° C.

8. The method defined in claim 7 wherein the oxidative treatment is carried out at a temperature of 250° C. to 550° C.

9. The method defined in claim 8 wherein the oxidative treatment is carried out at a temperature of 350° C. to 500° C.

10. The method defined in claim 1 wherein the oxidizing medium is air or pure oxygen.

11. The method defined in claim 1 wherein the oxidative treatment is carried out at a reduced pressure.

12. The method defined in claim 1 wherein the portion is cleaned in an ultrasound bath.

13. The method defined in claim 1 wherein the portion is cleaned with a high-pressure cleaner.

14. The method defined in claim 1 wherein the pyrolysis treatment of step b) is carried out at a subatmospheric pressure.

15. The method defined in claim 1 wherein the pyrolysis treatment of step b) is carried out under inert conditions.

16. The method defined in claim 1 wherein the oxidative treatment of step c) is carried out at a temperature between 350° C. to 500° C. in the presence of at least one oxidizing medium selected from the group consisting of air, oxygen-enriched air and pure oxygen.

* * * * *